United States Patent [19]

Tyler et al.

[11] Patent Number: 4,919,681

[45] Date of Patent: Apr. 24, 1990

[54] METHOD OF PREPARING CELLULOSIC FIBERS HAVING INCREASED ABSORBENCY

[75] Inventors: Robert A. Tyler, Candler; Henry C. Ramsey; Robert N. Armstrong, both of Asheville, all of N.C.

[73] Assignee: BASF Corporation, Williamsburg, Va.

[21] Appl. No.: 156,391

[22] Filed: Feb. 16, 1988

[51] Int. Cl.[5] ..... D06M 1/00; B32B 23/04

[52] U.S. Cl. ..... 8/116.1; 8/115.54; 604/375; 428/533

[58] Field of Search ..... 8/115.6, 116.1, 115.54; 604/375; 428/533

[56] References Cited

U.S. PATENT DOCUMENTS

| | | | |
|---|---|---|---|
| 1,835,866 | 12/1931 | Harold | 8/116.1 X |
| 2,538,279 | 1/1951 | Sisson et al. | 8/116.1 |
| 3,902,493 | 9/1975 | Baier et al. | 604/286 |
| 4,128,692 | 12/1978 | Reid | 428/378 |
| 4,240,937 | 12/1980 | Allen | 260/17.4 |
| 4,575,376 | 3/1986 | Shah | 8/116.1 |
| 4,634,439 | 1/1987 | Sustmann | 604/376 |
| 4,748,076 | 5/1958 | Saotome | 8/116.1 X |

OTHER PUBLICATIONS

Document dated 12/8/86 containing instructions for a shipment by BASF of Cellulosic Fibers to Int'l. Playtex.

*Primary Examiner*—Michael Lusignan
*Attorney, Agent, or Firm*—Tom R. Vestal

[57] ABSTRACT

A method of increasing the absorbency of cellulosic fibers by treating the cellulosic fibers with an aqueous acid solution having a pH value of no more than 4. The treatment is carried out for a time sufficient to obtain the desired absorbency. Optionally, the aqueous acidic solution treatment can be preceded or succeeded by a hot water treatment to further increase the absorbency of the cellulosic fibers. The cellulosic fibers find particular application in nonwoven articles that require high absorbency, i.e., diapers, tampons, medical sponges, etc.

22 Claims, No Drawings

METHOD OF PREPARING CELLULOSIC FIBERS HAVING INCREASED ABSORBENCY

BACKGROUND OF THE INVENTION

A. Field of the Invention

This invention relates to hypoallergenic cellulosic fibers having increased absorbency for water and physiological liquids and a method for their preparation.

B. Description of the Prior Art

Cellulosic fibers, because of their absorbency, have been found particularly useful in the production of nonwoven articles that require a high absorbency, such as diapers, tampons, sanitary napkins, medical sponges, soil mulches, wiping cloths, and the like. Each of these applications requires a material having a high capacity for absorbing and retaining water and other aqueous fluids, particularly body fluids. Cellulosic fibers have found wide use in these and similar applications because of the hydrophilic nature of the cellulose molecule and the fibrous structure which contributes integrity, form, shape, wicking ability, and liquid retention to a nonwoven material.

Various procedures have been proposed for increasing the absorbency of cellulosic fibers. For instance, the physical properties of cellulosic fibers, especially rayon fibers, have been altered by incorporating into the rayon a substance capable of increasing the fluid-holding capacity of the rayon, i.e., hydrophilic organic polymers or copolymers such as copolymers of acrylic acid and methacrylic acid or their alkali metal or ammonium salts. Representative of such a procedure is disclosed in U.S. Pat. No. 4,240,937, which is hereby incorporated by reference. These fibers are known as alloy rayon fibers, as the fibers are formed from a uniform mixture of an aqueous alkaline cellulose xanthate solution and the substance capable of increasing the fluid holding capacity of the rayon. A problem associated with this procedure is that undesirable losses and interaction can occur between the substance and the aqueous acidic spin bath into which the fluid containing cellulose and substance are regenerated to form the alloy rayon fibers. This problem can become particularly acute as the losses can floculate or agglomerate in the spin bath system.

Another procedure for increasing the absorbency of cellulosic fibers involves coating the surface of the fibers with a hydrophilic chemical, polymer, or gel in order to enhance the swelling of the cellulosic fibers. Representative of such a procedure is disclosed in U.S. Pat. No. 4,128,692, which is hereby incorporated by reference. A problem associated with this procedure is that many times the cellulosic fibers coated with the chemicals, polymer, or gel become glued, matted, or hard, which results in fibers that are difficult to process.

Whether utilizing chemicals, polymers, or gels to coat the cellulosic fibers or to produce alloy fibers, their use results in additional expenses. Also, their use can result in an allergic response to persons coming into contact with the cellulosic fibers containing the chemicals, polymers, or gels. Thus, there are certain advantages in using procedures which avoid the use of certain chemicals, etc.

One such proposed procedure for increasing the absorbency of cellulosic fibers without the use of these chemicals, etc., involves heating cellulosic fibers in a water bath at temperatures in the range of from 95° C. to 100° C. for periods ranging from one to sixty minutes.

This procedure is disclosed in U.S. Pat. No. 4,575,376, which is hereby incorporated by reference. Although this procedure has been somewhat successful, certain problems remain. For instance, for many applications, it is desirable that the absorbency of the cellulosic fiber be increased to a greater degree than resulting cellulosic fiber treated in accordance with U.S. Pat. No. 4,575,376. In addition, to achieve the desired absorbency of the cellulosic fibers for certain applications, it is sometimes necessary that the fibers be treated in the hot water bath for unacceptably long periods of time. In many commercial plant operating conditions, this amount of time results in unacceptable additional expenses for preparing cellulosic fibers having the desired amount of absorbency.

Thus, there is a need for a method for increasing the absorbency of cellulosic fibers which involves only modest cost and results in hypoallergenic cellulosic fibers having the increased absorbency.

SUMMARY OF THE INVENTION

The discovery has now been made that the absorbency of cellulosic fibrous materials can be increased by treating the cellulosic fibrous material with an aqueous acidic solution. Optionally, the cellulosic fibers can be treated with water having a temperature in the range of from about 95° C. to about 100° C. either prior to or after their treatment with the aqueous acidic solution.

The use of the method of the present invention involves only modest costs and results in cellulosic fibers having increased absorbency.

DESCRIPTION OF THE PREFERRED EMBODIMENTS

In accordance with the present invention, the absorbency of the cellulosic fibers is increased by contacting the cellulosic fibers with a aqueous acidic solution having a pH value of no more than 4 and for a period of time sufficient to increase their absorbency to the desired amount as measured by the Demand Absorption Test.

The precise manner in which the method of the invention increases the absorbency of the cellulosic fibers is not fully understood and need not be. Although the invention is not intended to be limited to any particular theory of operation, the increased absorbency may be attributable to morphological changes in the fibers. For instance, it is possible that degree of crystallinity is decreased whereby the absorption capacity is increased. Another proposed theory is that by contacting the cellulosic fibers with an aqueous acidic solution, an exchange of hydrogen ions for metal ions occurs, which results in cellulosic fibers having a reduced metal cation content. Furthermore, the increased absorbency may be due to a reduction in extractibles removed from the cellulosic fibers during the treatment. Regardless of the theories proposed, it is sufficient to point out that the method of the present invention operates successfully in the manner disclosed herein.

The term "cellulosic fibers" as used herein means regenerated cellulose such as viscose rayon, reformed cellulose, and natural cellulosic material such as cotton. Although increasing the absorbency of viscose rayon is very important for numerous commercial applications, it is also contemplated that the absorbency of natural cellulosic material including cotton and other similar cellulosic fibers such as cellulose acetate, cellulose diacetate, cellulose triacetate, ramie, hemp, wood pulp, chitin, and paper may also be increased using the method of the present invention.

The aqueous acidic solution used in the method of the invention is comprised of water and a sufficient amount of acidic material to lower the pH value of the resulting aqueous solution to the desired value. Acidic material can include, for instance, acids, acid anhydrides, buffers, and other substances including Lewis acids. Preferably, the aqueous solution is prepared by adding the acidic material to the water. Particularly preferred acidic materials suitable for use in the method of the invention include inorganic acids such as hydrochloric acid, hydrofluoric acid, phosphoric acid, sulfuric acid, nitric acid, organic acids such as citric acid, formic acid, acetic acid, propionic acid, butyric acid, acrylic acid, methacrylic acid, and combinations of inorganic and organic acids. Particularly preferred acids for use in the method of the invention are acetic acid, formic acid, sulfuric acid, phosphoric acid, hydrochloric acid, and mixtures thereof.

The time of contact of the cellulosic fibers with the aqueous acidic solution will vary over a wide range. Generally, however, the contact time will be for a period of from about 0.15 minutes to about 60 minutes, and, more preferably, from about 0.5 to about 2.5 minutes.

It is necessary that the aqueous acidic solution have a pH value of no more than 4. Preferably, the aqueous acid solution has a pH value in the range of from about 0 to about 4 and, more preferably, in the range of from about 0.5 to about 3.

With respect to the contact time and the lower pH value of the aqueous acidic solution, care should be exercised to ensure that the hydrogen ion concentration of the aqueous solution or contact time or combinations thereof do not cause hydrolysis of the fibers, which can result in degenerating the cellulosic fibers during their treatment such that the fibers are not suitable for their intended purpose. Therefore, treatment times of short duration are more desirable in many instances, particularly when the aqueous acidic solution has a high hydrogen ion concentration, i.e., low pH value. The optimum parameters in this regard can be easily ascertained by one skilled in the art.

Examples of preferred aqueous acidic solutions include aqueous solutions containing from about 1 to about 10 percent by volume acetic acid or formic acid and from about 0.5 to about 3 percent by volume of hydrochloric, sulfuric, or phosphoric acid. The preferred solution contains about 5 percent by volume acetic acid.

The temperature of the treatment of the fibers with acidic aqueous solution will vary over a wide range with no limitations. Generally, however, temperatures in the range of from about ambient (20°-25° C.) to about 70° C. and even up to 100° C. have been found to have a particular economic application. Preferably, the temperature of the treatment will be carried out in the range of from about 20° C. to about 60° C.

The method of the invention can be carried out using tap water, soft water, i.e., water having a low inorganic salt content, deionized water, i.e., water in which the non-sodium ion concentration has been reduced or eliminated, or distilled water.

Prior to or after the treatment of the cellulosic fibers with the aqueous acidic solution, the cellulosic fibers are preferably treated with hot water, i.e., water having a temperature in the range of from about 95° C. to about 100° C. and for a period of time from about 10 seconds to about 60 minutes. Utilizing the hot water treatment with the aqueous acid solution treatment, the absorbency of the cellulosic fibers is still further increased. Preferably, the hot water treatment is applied subsequent to the treatment with the acidic aqueous solution. A particularly preferred procedure for carrying out this treatment is disclosed in U.S. Pat. No. 4,575,376, which is hereby incorporated by reference. When the hot water treatment precedes the treatment with the aqueous acidic solution, the temperature of the fibers entering the aqueous acidic solution will be higher than when the fibers enter the aqueous acid solution without any hot water treatment. Whether this affects the final absorbency of the fibers is unknown. A particularly preferred procedure for carrying out the hot water treatment involves introducing the cellulosic fibers by means of a conveyor into a chamber wherein hot water is injected onto the fibers. By using this procedure, treatment of 10 seconds or more has been found to increase the absorbency of the cellulosic fibers.

The viscose solution used in producing viscose rayon fibers can be prepared by conventional procedures. One such procedure includes steeping conventional chemical cellulose sheet prepared from wood pulp or cotton linters in a caustic soda solution (NaOH) and thereafter removing caustic soda by pressing or the like to the desired solids content. The resulting alkali cellulose is shredded and, after aging, is mixed with carbon disulfide and mixed with water or dilute lye to form an aqueous xanthate (viscose) solution. For best results, the concentrations of the viscose solution are from about 5 to 10 percent by weight cellulose, from about 4 to 8 percent by weight sodium hydroxide, sufficient carbon disulfide to provide from about 1.7 to 3.0 percent sulfur and the remainder water.

The preparation of viscose rayon fibers suitable for treatment by the method of the present invention is known to persons skilled in the art. Generally, their preparation involves extruding or spinning a viscose solution through spinneret openings into an acid bath where cellulose fiber is regenerated. The regenerated fiber is stretched in air from 0-100%, or even higher, if desired, preferably from about 30 to 50% and then run through a hot bath which contains various amounts of dilute sulfuric acid, $ZnSO_4$ and sodium sulfate. The bath can be maintained at a temperature of from ambient to 100° C., preferably from 90°-97° C. The fiber is subjected to a second stretching of from 0 to 100% in the hot bath. The total stretch in both steps is preferably in the range of 50-70%. The stretching, which is well known, imparts the necessary strength to the finished fiber. The fibers, now a large bundle of continuous filaments or tow from the combined output of a number of spinnerets, are cut into short fibers of any desired length and washed to remove residual salts, for pH control, for bleaching, etc., dried to a moisture content of around 11%, and baled. Alternatively, tow can be washed, dried, and cut before bailing.

After the cellulosic fibers have been treated with the aqueous acidic solution, the cellulosic fibers can be treated with water. This treatment can be the previously described hot water treatment or the treatment can be carried out with water at ambient temperatures. Usually, this treatment time is from about 10 seconds to about 5 minutes. This step of the procedure is also helpful for removing any residual acid from the cellulosic fibers.

The cellulosic fibers may also be treated using procedures known to persons skilled in the art to provide a lubricant finish. The lubricants can be incorporated into the cellulosic fibers by including them in the desired treatment bath. Examples of suitable lubricants include polyoxyethylene sorbitan monoesters of higher fatty acids, e.g., polyoxyethylene sorbitan monolaurate, soaps, sulfonated oils, ethoxylated fatty acids, ethoxylated fatty esters of polyhydric alcohols, and fatty acid esters combined with emulsifying agents. These examples are merely exemplary, and other lubricating agents can be used in the present invention.

The cellulosic fibers prepared in accordance with the present invention can be blended with other fibers including nylon, polyester, polyacrylonitrile, polyolefin, wood pulp, chemically modified rayon or cotton, etc. The fibers may also be crimped by procedures known to persons skilled in the art. The cellulosic fibers of the present invention are adapted for use in a variety of articles, such as surgical dressings, pads, and vaginal tampons, in which high fluid holding retention is an essential characteristic. Typically, a tampon is an elongated cylindrical mass of compressed fibers, which may be supplied within a tube which serves as an applicator.

The use of the method of the present invention results in cellulosic fibers having an increase in absorbency as measured by the Demand Absorption Test of at least 4.0% over cellulosic fibers not treated by the method of the invention (control fibers). It ha also been found that absorbency increases up to 10% or even higher over control fibers can be achieved using the method of the invention.

The Demand Absorption Test as used throughout the specification and claims refers to a procedure which is described by Bernard M. Lichstein in "Demand Wettability, A New Method for Measuring Absorbency Characteristics of Fabric", a paper read at the International Nonwoven and Disposables Association, 2nd Annual Symposium on Non-Woven Product Development, Mar. 5–6, 1974, Washington, D.C. The test uses a novel apparatus which allows the measure of volume and rate of absorption of a fluid by maintaining the absorbent material at a zero hydrostatic head so that wetting occurs purely on demand by the absorbent material. Thus, the absorption of liquid occurs only by virtue of the ability of the absorbent material to demand liquid, with the flow of liquid abruptly stopping at the point of saturation.

The following examples will serve to more comprehensively illustrate the principles of the invention, but are not intended to limit the bounds of the invention.

EXAMPLES

Demand Absorption Test

Throughout the Examples, Demand Absorption Test was used to determine the amount of water held in cc. per gram of cellulosic fiber. The tests comprised the following procedure:

(a) Weigh 2.00 grams of carded rayon.
(b) Place the fiber in a 1-inch diameter die.
(c) Place the die with the fiber in a press and compress the fiber with a 6-inch piston at a pressure 1000 psi for 60 seconds to produce a fiber array having a thickness of about 0.25 inches.
(d) Remove the pellet from the die and place it on the sample support. (Note: The sample support and the foot of the plunger are each 1 inch in diameter. The pellet of fiber should not extend beyond the edge of the support or plunger.)
(e) Remove one representative pellet from the die and determine its residual moisture.
(f) Adjust weight of rayon of step (a) by subtracting the residual moisture of step (c) from this weight.
(g) Record the liquid level in the burette.
(h) Open valve A and then valve B. (See schematic of Lichstein paper).
(i) If flow of 0.85% by weight saline solution does not start spontaneously, then cause flow to start by placing a finger over the open tee and squeeze the bulb. Remove the finger from the tee.
(j) Allow flow to continue until no more bubbles enter the burette (or bubbles are 90 seconds apart).
(k) Record the liquid level in the burette. Close valve B and then valve A.
(l) Remove the pellet and prepare the apparatus for the next test.
(m) Report demand absorption by subtracting the first burette reading (g) from the second (k) and divide by the dry weight of the sample. The dimensions of the results are cc. per gram.

The cellulosic fibers utilized in the tests comprised wet, unfinished rayon staple fibers having a 3.0 denier and a length of 1–9/16". The fibers were bleached, crimped, and had a dull luster.

EXAMPLE I

A series of tests was carried out in order to determine the demand absorbency of cellulosic rayon fibers using different procedures.

1. Procedure for Samples C

A series of tests was carried out by immersing 50 g samples of cellulosic fibers into 2 liters of soft water having a temperature of 20° C. for a period of 1 minute, removing the samples from the soft water, and eliminating excess water from the fibers by placing the fibers in Buchner funnel under vacuum (hereinafter referred to as Step I), drying the fibers at a temperature of 55° C. for a period of 24 hours. The results reported in Table I represent the average of the tests.

2. Procedure for Samples H

These tests were carried out using the same manner as Samples C except that following Step I, and prior to drying, the samples were immersed in 2 liters of soft water having a temperature greater than 95° C. for a period of 5 minutes (hereinafter referred to as "Step II"), and quenched in 2 liters of soft water having a temperature of about 20° C. for a period of 1 minute (hereinafter referred to as "Step III"). Excess water was removed from the fibers between Steps II and III. The results reported in Table I represent the average of ten tests.

3. Procedure for Samples A

These tests were carried out in the same manner as Samples H, except that the water of Step II contained 5% by volume of acetic acid. The results reported in Table I represent the average of eight tests.

TABLE I

| Sample | Mass - Corrected (g) | Saline Absorption (ml) | Saline Absorption (ml) Mass (g) | Absorption Increase (%) Over Control |
|---|---|---|---|---|
| C (Control) | 2.13 | 9.62 | 4.53 | — |
| H | 2.10 | 10.25 | 4.88 | 7.81 |
| A | 2.10 | 10.89 | 5.2 | 14.85 |

The results of the tests demonstrate the effectiveness of the present invention in increasing the absorbency of cellulosic fibers.

EXAMPLE II

A series of tests was carried out by placing cellulosic fibers on a conveyor belt which traveled in a horizontal direction and had a feed rate of 0.5 lbs. of fiber per minute. The cellulosic fibers were treated sequentially using various procedures (steps) while on the belt. The steps are described with their designations in Table II below.

TABLE II

| Step | Designation | Fluid | Application | Rate of Application |
|---|---|---|---|---|
| Hot Water | HW | Hot Water | Spray | 84 l/lb. fiber |
| Acid | A | Water containing 5% by volume acetic acid and temp. of 20° C. to 60° C. | Spray & Rain Pan | 64 l/lb. fiber |
| Prewet Cold | PWC | 20° C. Water | Spray | 16 l/lb. fiber |
| Prewet Hot | PWH | 95° C. Water | Spray | 16 l/lb. fiber |
| Quench | Q | 22° C. Water | Spray | 54 l/lb. fiber |
| Finish | F | 37° C. Water Containing .3-.4% by volume standard finish | Rain Pan | 50 l/lb. fiber |
| Dry | D | — | Standard Dryer | — |

After treatment, the absorbency of cellulosic fibers was measured. The results of these tests are reported below in Table III. The results represented the average value of ten tests.

TABLE III

| Sample | Steps (Sequence) | Mass-Corrected (g) | Saline Absorption (ml) | Saline Absorption (ml) Mass (g) |
|---|---|---|---|---|
| C | PWC,Q,F,D | 2.00 | 9.65 | 4.83 |
| H | PWH,HW,Q,F,D | 1.98 | 9.81 | 4.96 |
| A | PWH,A,HW,Q,F,D | 1.94 | 10.12 | 5.22 |

The results of these tests show that cellulosic fibers treated with hot water containing acetic acid (Sample A) had an increase in absorbency of 8.17% when compared to the fibers treated with cold water but no acid (Sample C). Furthermore, the cellulosic fibers treated with hot water containing acetic acid (Sample A) had an increase in absorbency of 5.24% when compared to the fibers treated with hot water, cold water, but no acid (Sample H).

EXAMPLE III

A series of tests was carried out in order to determine the amount of absorbency of cellulosic fibers treated using various procedures. The steps of the procedures and their designations are set forth below in Table IV.

TABLE IV

| Step | Designation | Fluid | Time of Step (mins.) |
|---|---|---|---|
| Acid | A | 2 liter volume of acid at room temperature | 4 |
| Hot Water | HW | 2 liter volume of water at a temperature greater than 95° C. | 4 |
| Quench | Q | 2 liter volume of water having a temperature of 20° C. | 2 |
| Finish | F | 1 liter volume of water having ambient temperature and containing 0.5% by volume of a standard finish | 1 |
| Drying | D | Drying at 60° C. in a conventional drying oven. | 210 |

An amount of 50 grams of cellulosic fibers was used for each test. The acids used in the steps, their concentrations, and designations are set forth below in Table V.

TABLE V

| Acid | Concentration (% by Volume) | Designation |
|---|---|---|
| Acetic | 5 | Ac |
| Formic | 5 | FH |
| Sulfuric | 1 | S |
| Hydrochloric | 1 | HCl |
| Phosphoric | 1 | P |

Between each step, excess moisture was removed from the fibers by placing the fiber in a Buchner funnel under vacuum. The resulting fibers were measured for absorbency. The results of these tests are set forth in Table VI. The results represent the average value of five tests.

TABLE VI

| Sample | Steps | Mass - Corrected (g) | Saline Absorbency (ml) | Saline Absorbency (ml) Mass (g) | Average Absorbency Increase or Decrease (% Greater or Less Than Control) |
|---|---|---|---|---|---|
| 1 | Q,F,D (Control) | 1.99 | 9.23 | 4.63 | 0.00 |
| 2 | None | 2.01 | 9.37 | 4.66 | +0.61 |
| 3 | Q,D | 2.02 | 9.17 | 4.54 | −2.12 |
| 4 | HW,Q,F,D | 1.99 | 9.66 | 4.63 | +4.44 |

TABLE VI-continued

| Sample | Steps | Mass - Corrected (g) | Saline Absorbency (ml) | Saline Absorbency (ml) Mass (g) | Average Absorbency Increase or Decrease (% Greater or Less Than Control) |
|---|---|---|---|---|---|
| 5 | HW,A(Ac),Q,F,D | 2.00 | 10.06 | 5.03 | +8.51 |
| 6 | A(Ac),Q,F,D | 2.00 | 10.08 | 5.04 | +8.69 |
| 7 | HW,A(FH),Q,F,D | 2.04 | 10.14 | 4.98 | +7.35 |
| 8 | A(FH),Q,F,D | 2.02 | 9.98 | 4.94 | +6.52 |
| 9 | HW,A(S),Q,F,D | 2.02 | 9.90 | 4.90 | +5.82 |
| 10 | A(S),Q,F,D | 2.02 | 9.73 | 4.83 | +4.12 |
| 11 | HW,A(HCl),Q,F,D | 2.04 | 10.04 | 4.91 | +6.01 |
| 12 | A(HCl),Q,F,D | 1.99 | 9.63 | 4.85 | +4.67 |
| 13 | HW,A(P),Q,F,D | 2.01 | 9.84 | 4.89 | +5.58 |
| 14 | A(P),Q,F,D | 1.99 | 9.68 | 4.87 | +5.01 |

The results of these tests demonstrate the effectiveness of the present invention in increasing the absorbency of cellulosic fiber using various acids.

EXAMPLE IV

A series of tests was carried out using the same equipment and procedures as set forth in Example II. Various concentrations of acetic acid were utilized for the tests. The steps and designations correspond to those set forth in Table II, except that the amounts of acetic acid varied, an insulated chamber was used for the hot water step, and the dry step (D) was carried out for three hours with air having a temperature of 60° C. The results of these tests are set forth in Table VII.

TABLE VII

| Sample (Acid Conc. % by Volume) | Steps | Mass - Corrected (g) | Saline Absorbency (ml) | Saline Absorbency (ml) Mass (g) | Average Absorbency Increase or Decrease (% Greater or Less Than Control) |
|---|---|---|---|---|---|
| 1 (0) [Control] | PWC,Q,F,D | 2.11 | 9.66 | 4.59 | — |
| 2 (0) | PWC,HW,Q,F,D | 2.02 | 9.70 | 4.81 | +4.66 |
| 3 (0.05) | PWH,A,HW,Q,F,D | 2.00 | 9.44 | 4.73 | +3.05 |
| 4 (5.0) | PWH,A,HW,Q,F,D | 2.01 | 10.01 | 4.97 | +8.30 |
| 5 (10) | PWH,A,HW,Q,F,D | 2.03 | 9.91 | 4.88 | +6.23 |

The results of these tests demonstrate the effectiveness of the present invention using various concentrations of acetic acid and, particularly, when 5.0% by volume acetic acid is utilized.

EXAMPLE V

A series of tests was carried out in the same manner as Example IV, except in Test 2 a hot water treatment using soft water was applied to the cellulosic fiber prior to the application of an acid treatment containing 5% by volume acetic acid while in test 3, the hot water treatment was applied after the acid treatment. A series of ten (10) tests, including a control test, were utilized for each type of treatment. The averages of these tests are shown below in Table VIII.

TABLE VIII

| Test | Sequence | Saline Absorbency (ml) mass (g) | Amount of Absorbency Increase (% Greater Than Control) |
|---|---|---|---|
| 1 (Control) | PWC,Q,F,D | 4.47 | 0.00 |
| 2 | PWH,HW,A,Q,F,D | 4.84 | 8.40 |
| 3 | PWH,A,HW,Q,F,D | 4.89 | 9.46 |

EXAMPLE VI

A series of tests was carried out in the same manner as Example IV, except the acetic acid concentration varied according to the test and the hot water treatment was used either before the acid treatment or not at all. The results of the tests is reported in Table IX. Each result is the average of five (5) individual tests.

TABLE IX

| Test (Ac Conc.) | Steps (Sequence) | Saline Absorbency (ml) mass (g) | Amount of Absorbency Increase (% Greater Than Control) |
|---|---|---|---|
| 1 (0.0 Control) | PWC,Q,F,D | 4.57 | — |
| 2 (0.5) | PWH,HW,A,Q,F,D | 4.83 | 5.69 |
| 3 (5.0) | PWH,HW,A,Q,F,D | 4.83 | 5.61 |
| 4 (10.0) | PWH,HW,A,Q,F,D | 4.86 | 6.46 |
| 5 (0.5) | PWC,A,Q,F,D | 4.65 | 1.73 |
| 6 (5.0) | PWC,A,Q,F,D | 4.85 | 6.06 |
| 7 (10.0) | PWC,A,Q,F,D, | 4.88 | 6.75 |

EXAMPLE VII

A series of tests was carried out in the same manner as Example IV. A concentration of 5.0% by volume of acetic acid or a concentration of 2.5% by volume sulfuric acid was utilized and a hot water treatment preceded the acid treatment. The absorbency of the cellulosic fiber was compared to a control cellulosic fiber. The results of these tests are set forth in Table X. Each result is an average of five (5) tests for the control and 15 tests for the acid treatment tests.

TABLE X

| Tests (Acid) | Saline Absorbency (ml) mass (g) | Amount of Absorbency Increase (% Greater Than Control) |
|---|---|---|
| 1 (Control) | 4.45 | 0.00 |
| 2 (5.0% Ac) | 4.79 | 7.72 |
| 3 (2.5% S) | 4.81 | 8.09 |

The cellulosic fibers were then tested for various characteristics. The results of these tests are set forth in Table XI.

TABLE XI

| Characteristic | Control Fiber | 5.0% Ac Fiber | 2.5% S Fiber |
|---|---|---|---|
| Tenacity (gpd) | 2.3 | 2.5 | 2.5 |
| Conductivity | 25 $\Omega$ cm$^{-1}$ | 14 $\Omega$ cm$^{-1}$ (−44%) | 14 $\Omega$ cm$^{-1}$ (−44%) |

The results of these tests demonstrate the effectiveness of the present invention in increasing absorbency of cellulosic fibers. In addition, tests were performed on the fiber set forth in Tables X and XI for the purpose of evaluating the fibers for metal content, and the results of these tests indicated that the acid treated fibers of tests 2 and 3 had a reduced metal cation content for a number of metal cations which could decrease the absorbency of the cellulosic fiber, i.e., zinc, lead, etc., and no loss in tensile properties of the fiber.

Although certain preferred embodiments of the invention have been described for illustrative purposes, it will be appreciated that various modifications and innovations of the procedures and compositions recited herein may be effected without departure from the basic principles which underlie the invention. Changes of this type are therefore deemed to lie within the spirit and scope of the invention except as may be necessarily limited by the amended claims or reasonable equivalents thereof.

What is claimed is:

1. A method of increasing the absorbency of cellulosic fibers comprising:

contacting said cellulosic fibers with an aqueous acidic solution having a pH value of no more than 4;

and thereafter treating the cellulosic fibers with water for about ten seconds to about five minutes; whereby the resulting cellulosic fibers consist essentially of cellulose.

2. The method recited in claim 1 wherein said cellulosic fibers are contacted with said aqueous acidic solution for a period of time in the range of from about 0.15 to about 60 minutes.

3. The method recited in claim 1 wherein said pH value is in the range of from about 0.5 to about 3.

4. The method recited in claim 3 wherein said aqueous acidic solution has a temperature in the range of from about 20° C. to about 100° C.

5. The method recited in claim 1 wherein the acid is selected from the group consisting of hydrochloric acid, hydrofluoric acid, phosphoric acid, sulfuric acid, nitric acid, citric acid, formic acid, acetic acid, propionic acid, butyric acid, acrylic acid, methacrylic acid, and mixtures thereof.

6. The method recited in claim 5 wherein the increase of absorbency of said resulting cellulosic fibers is at least 4.0% as measured by Demand Absorption Test.

7. The method recited in claim 6 further comprising the step of contacting said cellulosic fibers with water having a temperature of at least 95° C. either prior to or after contacting said cellulosic fibers with said aqueous acidic solution.

8. The method recited in claim 7 wherein said water contacts said cellulosic fibers prior to said aqueous acidic solution contacting said fibers.

9. The method recited in claim 7 wherein said water contacts said cellulosic fibers after said acidic aqueous solution contacts said cellulosic fibers.

10. The method recited in claim 7 wherein said cellulosic fibers are viscose rayon fibers.

11. The method recited in claim 7 wherein said cellulosic fibers are natural cellulosic material.

12. The method recited in claim 2 wherein said aqueous acidic solution is selected from the group consisting of an aqueous solution containing from about 1 to about 10 percent by volume acetic acid, an aqueous solution containing from about 0.5 to about 3.0 percent by volume of hydrochloric acid, sulfuric acid or phosphoric acid, and mixtures thereof.

13. The method recited in claim 12 wherein said cellulosic fibers are contacted with said aqueous acidic solution for a period of time in the range of from about 0.5 to about 2.5 minutes.

14. The method recited in claim 13 wherein said aqueous acidic solution has a temperature in the range of from about 20° C. to about 60° C.

15. The method recited in claim 14 wherein the increase of absorbency of said resulting cellulosic fibers is at least 10% as measured by the Demand Absorption Test.

16. The method recited in claim 7 wherein said cellulosic fibers are contacted with said water for a period of time in the range of from about 10 seconds to about 5 minutes.

17. Cellulosic fibers prepared in accordance with claim 1.

18. The cellulosic fibers recited in claim 17 further comprising a lubricant finish.

19. A method of increasing the absorbency of viscose rayon fibers comprising contacting said viscose rayon fibers with an aqueous acid solution having a pH no greater than 4 and comprising an acid selected from the group consisting of acetic acid, sulfuric acid, hydrochloric acid, formic acid, phosphoric acid, and mixtures thereof; and thereafter treating the viscose rayon fibers with water from about ten seconds to about five minutes; whereby said absorbency of the resulting viscose rayon fibers is increased to at least 4.0% as measured by demand absorption test and consists essentially of cellulose.

20. Cellulosic fibers prepared in accordance with claim 19.

21. The method recited in claim 19 wherein said resulting viscose rayon fibers are contacted with water having a temperature of at least 95° C. after said fibers have been contacted with said aqueous acidic solution.

22. The method recited in claim 19 wherein said viscose rayon fibers are contacted with water having a temperature of at least 95° C. prior to being contacted with said aqueous acid solution.

* * * * *